US007498496B2

(12) United States Patent
Meadors

(10) Patent No.: US 7,498,496 B2
(45) Date of Patent: Mar. 3, 2009

(54) MITCHEL'S TONE RING MATE

(75) Inventor: Mitchel Devern Meadors, Leavittsburg, OH (US)

(73) Assignee: Mitchel Meadors, Leavittsburg, OH (US)

( * ) Notice: Subject to any disclaimer, the term of this patent is extended or adjusted under 35 U.S.C. 154(b) by 0 days.

(21) Appl. No.: 11/678,682

(22) Filed: Apr. 19, 2007

(65) Prior Publication Data

US 2008/0257129 A1 Oct. 23, 2008

(51) Int. Cl.
*G10D 1/10* (2006.01)

(52) U.S. Cl. ..... 84/270; 84/269; 84/271; 84/272

(58) Field of Classification Search ..... 84/269–272
See application file for complete search history.

(56) References Cited

U.S. PATENT DOCUMENTS 443,159 A * 12/1890 Bradbury ..... 84/269
443,510 A * 12/1890 Fairbanks ..... 84/269
1,437,982 A * 12/1922 Luckett ..... 84/272
1,512,766 A * 10/1924 Houdlett ..... 84/272
1,724,629 A * 8/1929 Williamson ..... 84/269
3,677,125 A * 7/1972 Oliver ..... 84/271
3,921,492 A * 11/1975 Stelling ..... 84/269
4,226,159 A * 10/1980 Lowe ..... 84/272
4,483,234 A * 11/1984 Snavely ..... 84/269
4,852,446 A * 8/1989 Kennedy ..... 84/272
5,355,756 A * 10/1994 Geiger ..... 84/270
2005/0223870 A1 * 10/2005 Passafiume ..... 84/269

* cited by examiner

*Primary Examiner*—Walter Benson
*Assistant Examiner*—Robert W Horn

(57) ABSTRACT

"Mitchel's Tone Ring Mate" is completely new to the banjo world. The "Mitchel's Tone Ring Mate" is a smaller tone ring in itself, sitting on top of the original raised head tone ring at 25 thousands higher and at opposite angles, thus converting the original raised head tone ring to a flat head tone ring. Being completely different than any other invention. This doing, by design, composition and development, unknown in manufacturing there into.

1 Claim, 2 Drawing Sheets

Fig. 2

MITCHEL'S TONE RING MATE

BACKGROUND

1. Field of Invention

This invention relates to the stringed musical instrument properly known as the banjo.

2. Description of Prior Art

The major components of a banjo rim assembly (circular part of banjo) are 1. head (skin or plastic) 2. tone ring (metal) 3. shell (usually wood): "Mitchel's Tone Ring Mate" (FIG. 1) installed on top and sitting in the raised head ring converting it to a flat head 4. sub parts to make previously mentioned parts into a single taut assembly.

Banjos Typically are of Two Types:

1. Raised head—having a tone ring that reduces the main vibrating area of the head to the approximate inside diameter measurement of the shell.
2. Flat head—having a tone ring that maintains the vibrating area of the head to the approximate outside diameter measurement of the shell.

DESCRIPTION OF THE PREFERRED EMBODIMENT

Installing "Mitchel's Tone Ring Mate" on the (original) raised head ring converts the (original) raised head ring to a flat head.

Previous conversions either eliminated the original ring or didn't sit inside and firmly on the flat inside surface of the original raised head ring; thus utilizing the pre-war material of the (original) raised head ring.

In relationship to the (original) raised head tone ring (as seen in FIG. (2)), "Mitchel's Tone Ring Mate" sits in the open cavity of the (original) raised head tone ring. The bottom's diameter, measuring at 10.825, rests on the inside bottom of (original) raised head tone ring setting against the inside of the (original) raised head tone ring with a diameter of 9.950. The outside diameter being 10.992 and setting on the outside skirt of (original) raised head tone ring, running perpendicular to the (original) raised head tone ring with a radius of 0.060 and a theoretical diameter of 10.800.

In reference to the 51° angle of the "Mitchel's Tone Ring Mate", it starts at the 10.8 and goes to the 9.950 then back to the 0.340, has a height of 0.025 above the (original) raised head tone ring, thus forming a flat head tone ring conversion utilizing the (original) raised head tone ring with "Mitchel's Tone Ring Mate".

Figure 1:
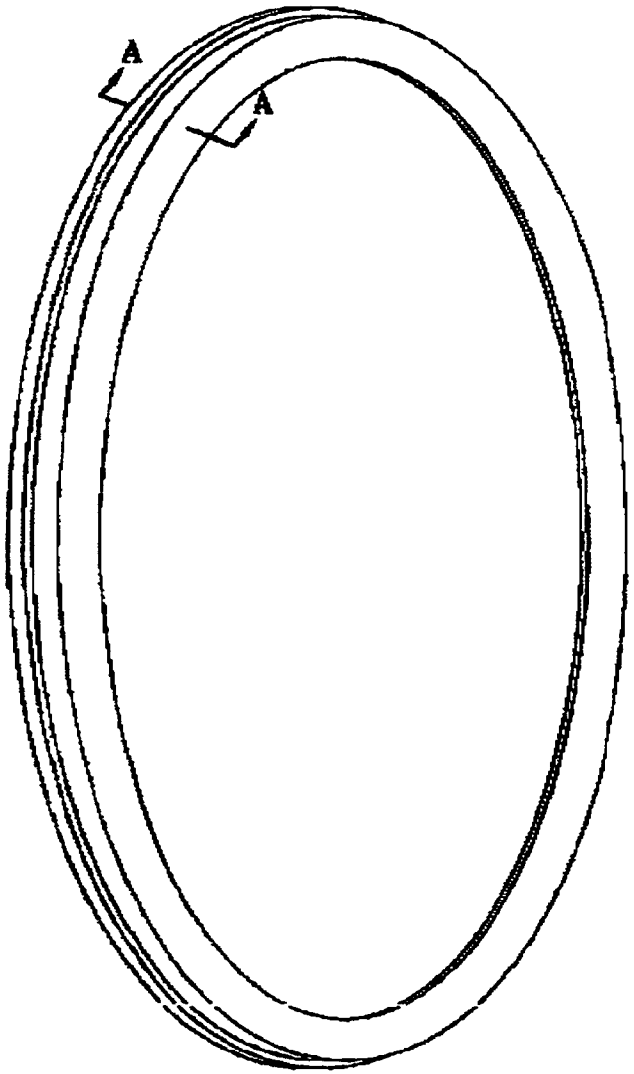
FIG. 1 is a full view of "Mitchel's Tone Ring Mate"
Figure 2:
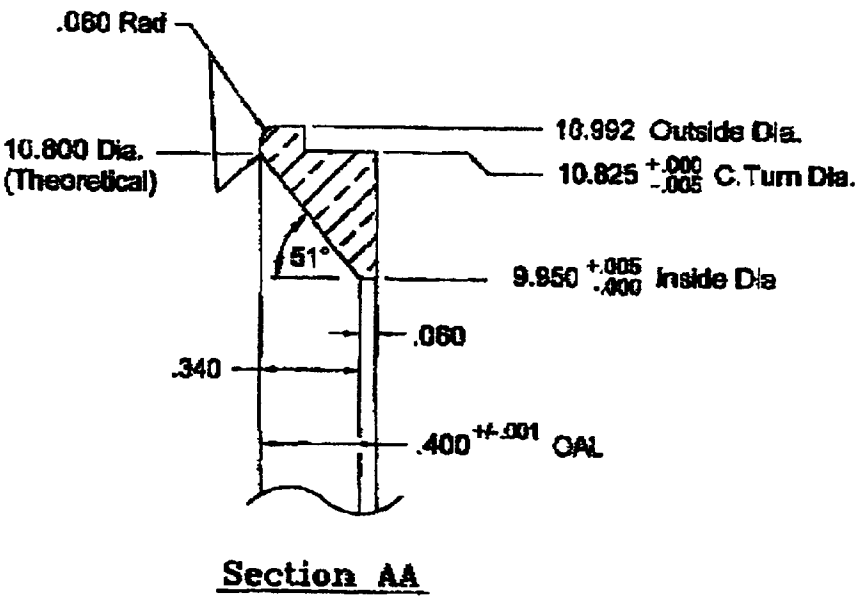
FIG. 2 is a cross-sectional exploded view of "Mitchel's Tone Ring Mate"
Figure 3:
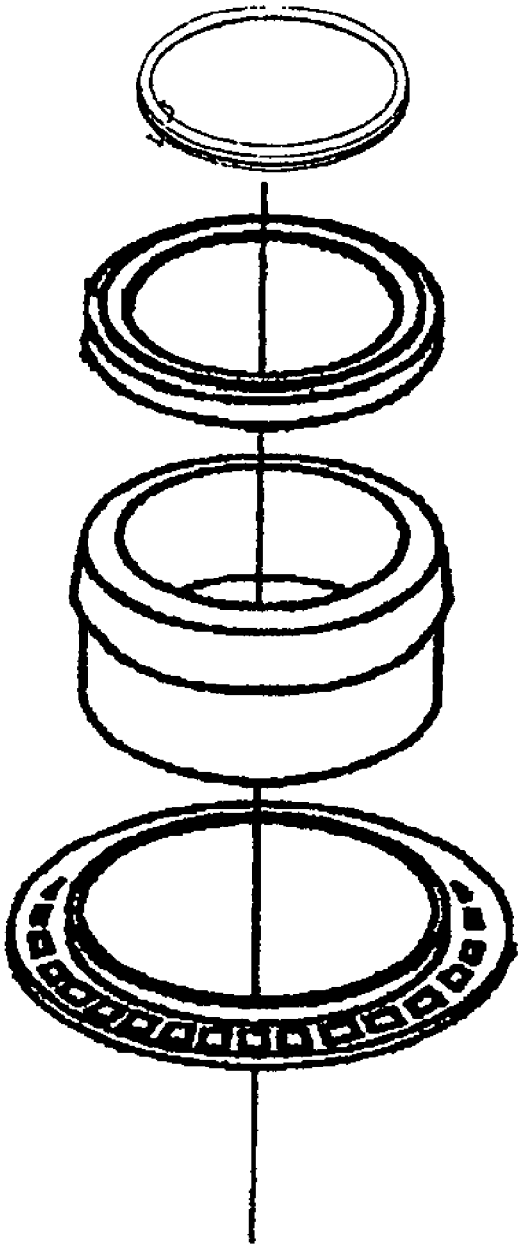
FIG. 3 is a view of the banjo components with "Mitchel's Tone Ring Mate" at the very top of the assembly.

With "Mitchel's Tone Ring Mate", as shown in drawing (FIG. 3) the owner simply removes the head, puts "Mitchel's Tone Ring Mate" inside raised head cavity and on top of (original) tone ring and reinstalls the head, converting this assembly to a pre-war sounding flat head by utilizing the (original) raised head ring material with "Mitchel's Tone Ring Mate". No other conversion sits down in the raised head cavity and has a design that utilizes the raised head ring, then converting it to a flat head with the unique and new design of "Mitchel's Tone Ring Mate".

I claim:

1. A tone ring apparatus comprising:

a supplementary annular body configured to mate to a raised head tone ring on a banjo body, the banjo body comprising:

a raised head tone ring;

a banjo shell, supporting the said raised head tone ring;

a banjo flange mated to the banjo shell; and a banjo head that customarily rests on the raised head tone ring;

wherein the supplementary annular body rests on the raised head tone ring on a lower surface and interfaces the head of the assembled banjo on an upper surface in the place of the raised head tone ring and converts the banjo to a flat head banjo.

* * * * *